United States Patent [19]

Ohshita et al.

[11] Patent Number: 4,864,286

[45] Date of Patent: Sep. 5, 1989

[54] SWITCH OPERATION MONITORING APPARATUS

[75] Inventors: Youichi Ohshita; Akira Hashimoto; Masanori Tsukushi; Yukio Kurosawa; Kiyoshi Okumura, all of Hitachi, Japan

[73] Assignee: Hitachi, Ltd., Tokyo, Japan

[21] Appl. No.: 180,965

[22] Filed: Apr. 13, 1988

[30] Foreign Application Priority Data

Apr. 13, 1987 [JP] Japan ..... 62-88831

[51] Int. Cl.[4] ..... G08B 21/00

[52] U.S. Cl. ..... 340/644; 324/424; 340/635

[58] Field of Search ..... 340/638, 639, 644; 324/415, 423, 424; 361/2; 200/148 A, 81.5

[56] References Cited

U.S. PATENT DOCUMENTS 4,433,293 2/1984 Aoyagi et al. ..... 324/424

FOREIGN PATENT DOCUMENTS 58-28615 2/1983 Japan .

61-203820 9/1986 Japan .

*Primary Examiner*—Joseph A. Orsino

*Assistant Examiner*—Jeffery A. Hofsass

*Attorney, Agent, or Firm*—Antonelli, Terry & Wands

[57] ABSTRACT

Disclosed is a switch operation monitoring apparatus for quickly and accurately detecting an abnormal operation of an actuating mechanism actuating a switch such as a power circuit breaker. A normal characteristic stroke of a moving part of the actuating mechanism is previously calculated on the basis of an interrupting current waveform, an environmental gas pressure and an actuating fluid pressure while taking into account the structure of the switch so as to use the calculated characteristic stroke as a reference stroke, and this reference stroke is compared with an actually measured characteristic stroke to decide whether the operation of the actuating mechanism actuating the switch is normal or abnormal.

7 Claims, 2 Drawing Sheets

SWITCH OPERATION MONITORING APPARATUS

BACKGROUND OF THE INVENTION

This invention relates to switches including circuit breakers, disconnecting switches, earthing switches and the like disposed in electric power systems, and more particularly to a switch operation monitoring apparatus for detecting an abnormal operation of an actuating mechanism for such a switch as early as possible.

Now, there is a strong tendency toward development of a technique for so-called preventive maintenance of power transmission and transformation equipments, and improvements in the reliability of power transmission and transformation, especially, interruption-free power transmission is strongly demanded. According to statistics of failures of switches such as circuit breakers, malloperation of the circuit breakers attributable to an abnormal operation of their actuating mechanisms occurs most frequently and occupies the majority of the breaker failures. However, the actuating mechanism has a very large number of parts. Therefore, development of the so-called preventive maintenance technique for the circuit-breaker actuating mechanism is now demanded. According to the preventive maintenance technique, the movement of the movable electrode of the circuit breaker during its circuit interrupting operation, that is, the characteristic stroke of the movable electrode during the circuit interrupting operation is measured so as to detect an abnormal operation of the actuating mechanism as early as possible on the basis of whether or not a distortion is present in the measured characteristic stroke.

Many methods for measuring the characteristic stroke of the movable electrode of a circuit breaker have been proposed hitherto. For example, JP-A-No. 58-28615 discloses a method in which an optical fiber is used to electrically insulate a measuring instrument so as to permit measurement of movement of a high potential part. More precisely, according to the first prior art described above, optical marks spaced apart by a predetermined distance from each other are disposed in such a relation that ranges having different reflection factors are continuously alternated at a predetermined pitch. Light from a light source is projected onto the optical marks, and the amount of light reflected from the optical marks is converted into an electrical signal and the number of the optical marks is counted so as to measure the moving distance of a moving body.

The present invention contemplates to provide an algorithm used for deciding the presence or absence of an abnormal operation of, for example, a circuit-breaker actuating mechanism on the basis of the presence or absence of a distortion in the measured characteristic stroke of the movable electrode of the circuit breaker, as described in detail later. In the present invention, any one of known means can be used for the measurement of the characteristic stroke. A simple method for measuring such an operational characteristic is disclosed in, for example, JP-A-No. 61-203820. In the publication, the period of time required for operation of an auxiliary contact interlocked with a circuit breaker is measured. More precisely, according to the second prior art described above, a plurality of auxiliary contacts opened and closed in interlocking relation with operation of a circuit-breaker actuating system are provided, and the period of time required until the auxiliary contacts operate in response to the application of a trigger signal to the closing coil or trip coil of the circuit breaker is compared with a reference value so as to detect whether the operation of the actuating system is normal or abnormal. In other words, according to the second prior art proposing the manner of decision of an abnormal operation of the circuit-breaker actuating system, a reference operational characteristic is stored in a memory and compared with the operational characteristic actually measured during the circuit interrupting operation, and the difference between them is based to detect whether the operation of the actuating system is normal or abnormal. However, the reference operational characteristic used in the prior art represents that measured under no load, that is, at the time where no current interrupting operation is being carried out. Thus, no consideration has been given to the current interrupting operation under the on-load condition.

In the actual current interrupting operation of a circuit breaker, the characteristic stroke of its movable electrode is subjected to variations due to three factors described below even when the circuit-breaker actuating mechanism is normally operating.

The first factor causing the variation of the characteristic stroke is the actuation reaction force generated due to a pressure rise of gas in a puffer cylinder during the current interrupting operation. In a puffer type gas circuit breaker which is most sensitive to such a gas pressure rise, the range of reaction force variation amounts sometimes to a maximum of several tons. Besides the magnitude of the interrupting current, the actuation reaction force is greatly affected by the phase of the interrupting current relative to the starting time of the current interrupting operation. This first factor is greatest among the three factors causing undesirable variations of the operational characteristic of the circuit-breaker actuating mechanism during the current interrupting operation.

The second factor is a variation of the actuating force. When the actuating mechanism of the puffer type gas circuit breaker uses, for example, compressed air as the source of the actuating force, the pressure of the compressed air is controlled to lie within an allowable variation range of about $\pm 10\%$. When the pressure of the compressed air varies within the above range, variations of the actuating force and operational characteristic of the circuit-breaker actuating mechanism are not negligible.

The third factor is a variation of the pressure of gas enclosed in the puffer type gas circuit breaker. When $SF_6$ gas is filled in the puffer type gas circuit breaker as an arc extinguishing medium, the pressure of the $SF_6$ gas is controlled to lie within an allowable variation range of about $\pm 20\%$. Thus, when the pressure of the $SF_6$ gas varies within the above range, and even when the actuating mechanism is normally operating without any trouble, the characteristic stroke of the movable electrode of the circuit breaker will vary greatly depending on the current interrupting condition. Therefore, when a prior art method is employed in which the characteristic stroke subjected to a variation is compared with the normal characteristic stroke to decide whether the operation of the actuating mechanism is normal or abnormal, a wide allowable variation range of the gas pressure must be set so as to deal with usual variations of the characteristic stroke during usual operations such as change-over of system circuits and breaking of an abnormal current. The requirement for setting such a wide allowable range of variation of the gas pressure has abstructed the desired improvement in the sensitivity of detection of an abnormal operation of the actuating mechanism.

According to another prior art method proposed to deal with the problem described above, the circuit breaker is periodically disconnected from the electric power system for the purpose of periodic inspection and is actuated under no load so as to measure the operational characteristic of the actuating mechanism. However, this periodic inspection of the circuit breaker provides a hindrance to the continuity of the service of the electric power system, while a decreased frequency of inspection impairs the reliability of electric power supply.

Thus, all of the prior art disclosures have not taken the variations of the actuating force, pressure of environmental gas and interrupting current into consideration, and the desired improvement in the sensitivity of detection of an abnormal operation of the circuit-breaker actuating mechanism has been inevitably limited.

SUMMARY OF THE INVENTION

It is a primary object of the present invention to provide an apparatus for monitoring the operation of a switch such as a puffer type gas circuit breaker, in which the adverse effects of variations of the actuating force, pressure of environmental gas and interrupting current are substantially eliminated and which can reliably detect an abnormal operation of the the actuating mechanism of the circuit breaker with high sensitivity by comparing a detected characteristic stroke with the normal characteristic stroke of the movable electrode of the circuit breaker.

Another object of the present invention is to provide an apparatus of the kind described above in which the characteristic stroke of the movable electrode during the current interrupting operation is measured to diagnose whether the measured characteristic stroke is abnormal or not, so that the prior art process of stopping the power supply for the diagnostic purpose and actuating the circuit breaker under no load to inspect the operation of the circuit-breaker actuating mechanism can be dispensed with.

The above objects are attained by previously determining the normal or reference characteristic stroke of the movable electrode of the circuit breaker by calculation on the basis of the actuating force actuating the circuit breaker for switching operation, the pressure of environmental gas and the waveform of interrupting current while taking the structure of the circuit breaker into consideration, comparing the actually measured characteristic stroke with the reference characteristic stroke, and diagnosing to decide whether the operation of the circuit-breaker actuating mechanism is normal or abnormal.

The pressure rise of gas in a circuit breaker during its current interrupting operation is discussed in IEEE Transactions on Power Apparatus and Systems, Vol. Pas-98, No. 3, May/June (1979) pp. 731–737, and the accuracy of estimation of the internal gas pressure rise has already attained a practically usable level. More precisely, in the calculation, data of the operation conditions including the actuating force imparted during current interrupting operation, the pressure of environmental gas and the waveform of interrupting current as well as data of the constants peculiar to the switch including the shape and weight of the movable part and the link ratio of the link mechanism are used as inputs to determine the normal or reference characteristic stroke of the movable part as an output. The value of the reference characteristic stroke thus calculated is now practically satisfactorily usable. In the present invention, the characteristic stroke of the movable part during the current interrupting operation of the switch is first actually measured. At the same time, the actuating force, the pressure of environmental gas, and the current value of interrupting current as well as the phase angle of the interrupting current during the interrupting operation are measured. The actuating force is provided by the pressure of actuating fluid supplied from a pneumatic actuator, an oil hydraulic actuator or the like. The pressure of environmental gas is the pressure of $SF_6$ gas when the switch is a puffer type gas circuit breaker using $SF_6$ gas. The phase angle of the interrupting current during the interrupting operation corresponds to the period of time required for extinguishing the interrupting current from the starting time of the current interrupting operation. On the basis of the various values described above, the normal or reference characteristic stroke of the movable part of the switch during the normal interrupting condition is calculated. Then, an actually measured characteristic-stroke of the movable part is compared with the reference characteristic stroke so as to eliminate the aforementioned adverse effects of variations of the characteristic stroke dependent upon the interrupting condition. Thus, in the determination of the reference value used for decision of an abnormal operation of the actuating mechanism, the allowable variation range need not be unnecessarily widened so that the accuracy of detection of the presence or absence of an abnormal operation of the actuating mechanism can be improved.

BRIEF DESCRIPTION OF THE DRAWINGS

Preferred embodiments of the present invention will now be described in conjunction with the accompanying drawings, in which.

DESCRIPTION OF THE PREFERRED EMBODIMENTS

Figure 1:
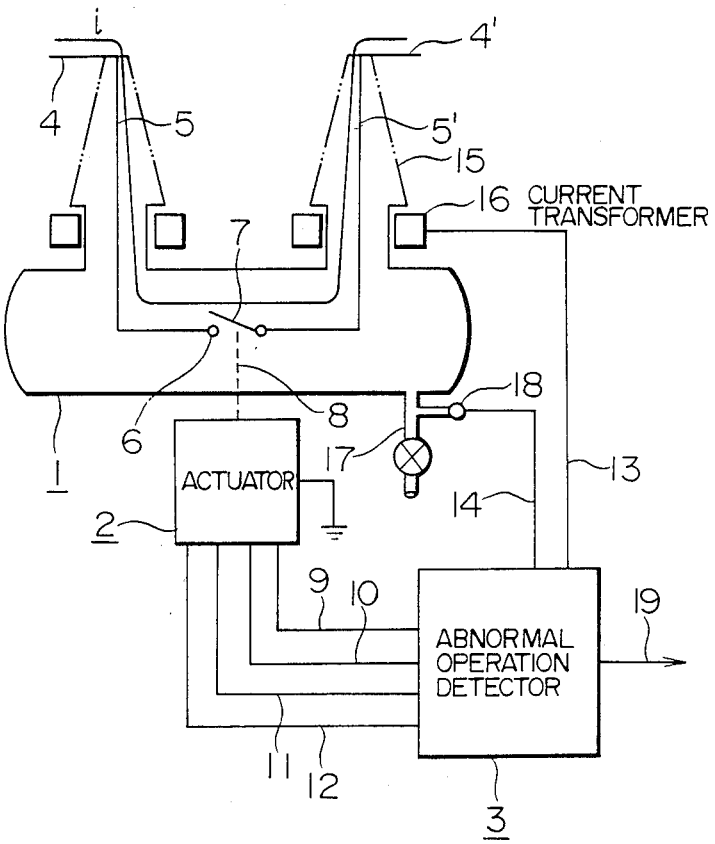
FIG. 1 is a systematic diagram showing an embodiment of the present invention.

An embodiment of the switch operation monitoring apparatus according to the present invention will now be described with reference to FIG. 1. Referring to FIG. 1, $SF_6$ gas, whose pressure is controlled at 4 to 6 atmospheres, is enclosed in a gas circuit breaker 1. Current i flows from a conductor 4 connected to an electric power system toward a conductor 4' connected to another electric power system through an internal conductor 5, a stationary electrode 6, a movable electrode 7 and another internal conductor 5'. An actuator 2 is grounded through a point of ground potential. The movable electrode 7 of the circuit breaker 1 is brought to its circuit closing position and its circuit breaking position by the actuator 2 through an insulated driving member 8. An abnormal operation detector 3 functions as an operational characteristic measuring device. An interrupting instruction signal 9, a closing instruction signal 10, a signal 11 representing the pressure of an actuating fluid, a signal 12 representing the characteristic stroke of the movable electrode 7, a signal 13 representing the waveform of the interrupting current i, and a signal 14 representing the pressure of the $SF_6$ gas are applied to the abnormal operation detector 3 from the circuit breaker 1 and actuator 2 by way of individual signal lines respectively. The interrupting instruction signal 9 and the closing instruction signal 10 are branched from those applied to the circuit breaker 1 from an electric power system controller (not shown). These signals 9 and 10 trigger the operation of the abnormal operation detector 3. Thus, when the abnormal operation detector 3 is triggered in response to the application of the closing instruction signal 10, the operation of the circuit breaker 1 during its interrupting position can also be diagnosed. The signal 11 representing the pressure of the actuating fluid is based to determine the actuating force, and the actuating force is calculated on the basis of the structural data of the actuator 2 stored in an internal memory (not shown) of the abnormal operation detector 3. The signal 12 representing the characteristic stroke may be that obtained by measuring the movement of a freely selected point between the actuator 2 and the movable electrode 7. However, from the aspect of the reliability of electrical insulation, the signal 12 is preferably derived from a point located on a moving part held at the ground potential. The signal 13 representing the waveform of the current i is derived from a current transformer 16 located beneath a bushing 15. The method for measuring the current i is not especially limited. However, because such a current transformer 16 is commonly provided on the gas circuit breaker 1, and the current waveform can be simply detected by the current transformer 16, the signal 13 is derived from the current transformer 16. The signal 14 representing the gas pressure is derived from a pressure gauge 18 which is installed in a gas supply and exhaust duct 17 to measure the pressure of the $SF_6$ gas. The pressure gauge 18 is disposed at such a position because the scale of modifying the arrangement can be minimized when the present invention is applied to an existing circuit breaker. Various structural data of the movable parts of the circuit breaker 1 and actuator 2 are previously stored in the internal memory of the abnormal operation detector 3. A program is incorporated in the abnormal operation detector 3 so that an abnormal operation indication signal 19 can be generated when the result of comparison between the normal or reference characteristic stroke calculated on the basis of the normal operating conditions of the circuit breaker 1 making its interrupting operation and closing operation and the actually measured characteristic stroke proves that an abnormal operation has occurred. The abnormal operation detector 3 may have any one of various circuit structures including an analog circuit, a digital circuit and a hybrid circuit. The basic function of the abnormal operation detector 3 will be described with reference to a block diagram of FIG. 2 or 3.

Figure 2:
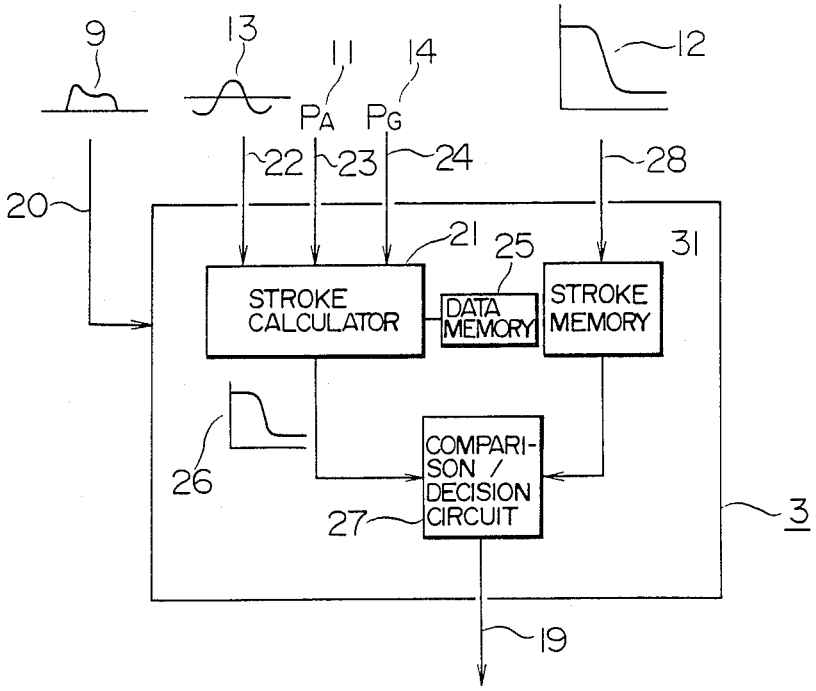
FIG. 2 is a block diagram showing the detailed structure of part of the apparatus shown in FIG. 1.

FIG. 2 is a block diagram showing in detail the structure of one form of the abnormal operation detector 3 shown in FIG. 1. In the form of the abnormal operation detector 3 shown in FIG. 2, the operational characteristic of the circuit breaker 1 during its interrupting operation is claculated in real time. The abnormal operation detector 3 starts its operation by being triggered by the interrupting instruction signal 9 applied by way of a signal line 20. The signal 11 representing the actuating air pressure ($P_A$) and the signal 14 representing the environmental gas pressure ($P_G$) are applied by way of respective signal lines 23 and 24 to a characteristic stroke calculation circuit 21 to be sequentially sampled and held in the circuit 21. The signal 13 representing the current waveform is also applied by way of a signal line 22 to the characteristic stroke calculation circuit 21 to be sequentially sampled and held in the circuit 21. A data memory 25 stores structural data including data of the weights of the movable parts of the circuit breaker 1 and actuator 2. On the basis of the values of the actuating air pressure $P_A$, environmental gas pressure $P_G$ and current waveform held in the characteristic stroke calculation circuit 21 and on the basis of the structural data supplied from the data memory 25, the characteristic stroke calculation circuit 21 calculates a reference characteristic stroke to be used for the decision of the presence or absence of an abnormal operation, and its output signal 26 representing the calculated reference characteristic stroke is applied to a comparison/decision circuit 27. The signal 12 representing the actually measured characteristic stroke is applied to an actually measured stroke data memory 31 by way of a signal line 28 to be stored in the memory 31. The actually measured characteristic stroke 12 stored in the memory 31 is compared with the calculated reference characteristic stroke 26 in the comparison/decision circuit 27, and, when the difference between the former and latter strokes is larger than a predetermined setting, an abnormal operation indication signal 19 is generated from the comparison/decision circuit 27. There are various modes for decision of the presence or absence of an abnormal operation, and there are also various settings of the decision level. Therefore, the optimum mode differs depending on the structure of the circuit breaker. In the present invention, the allowable value of the difference between the position of the movable electrode 7 actually measured every instant and the calculated position of the movable electrode 7 is selected to lie within the range of less than 10% of the full stroke. In the form of the abnormal operation detector 3 shown in FIG. 2, the reference characteristic stroke is calculated on the basis of the actually measured values of the gas pressure $P_G$ and actuating air pressure $P_A$. Therefore, the embodiment of the present invention can deal with all the interrupting conditions.

Figure 3:
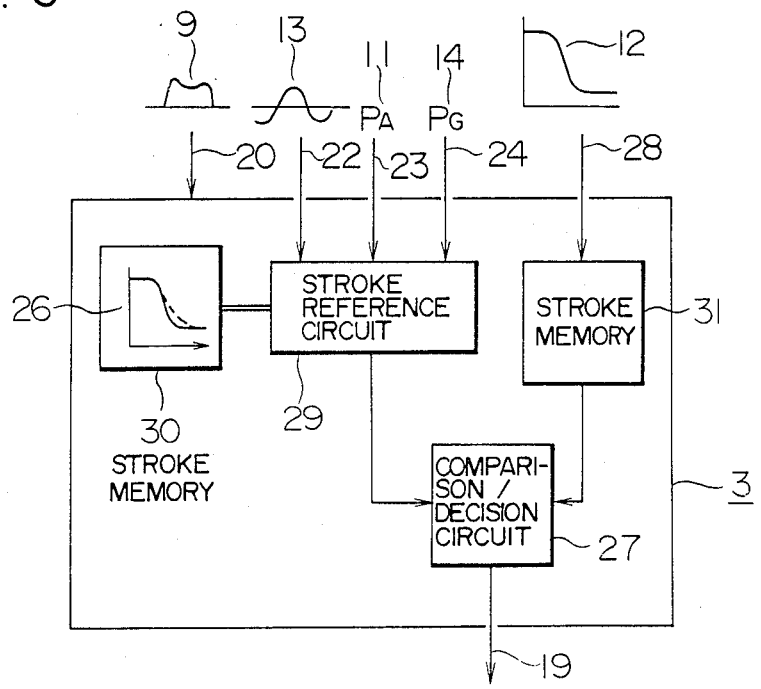
FIG. 3 is a block diagram showing the detailed structure of part of another embodiment of the present invention.

FIG. 3 is a block diagram showing in detail the structure of another form of the abnormal operation detector 3 incorporated in another embodiment of the present invention. In FIG. 3, the same reference numerals are used to designate the same parts and signals appearing in FIG. 2.

In the form of the abnormal operation detector 3 shown in FIG. 3, a plurality of characteristic strokes are previously calculated using the interrupting condition as a parameter and are stored in a characteristic stroke memory 30, in order to avoid the stroke calculation circuit from becoming large in scale and also in order to shorten the response time while slightly sacrificing the accuracy of detection. Herein, the difference between the structure shown in FIG. 2 and that shown in FIG. 3 will only be described. In FIG. 3, a stroke reference circuit 29 is provided in place of the stroke calculation circuit 21 shown in FIG. 2. On the basis of the detected magnitude and phase of the interrupting current waveform 13 and the actually measured values of the actuating fluid pressure 11 and gas pressure 14, the stroke reference circuit 29 reads out from the memory 30 the characteristic stroke 26 calculated at the condition nearest to the actual interrupting condition, and an output signal representing the selected characteristic stroke 26 is applied from the stroke reference circuit 29 to the comparison/decision circuit 27. Therefore, in spite of the simple structure, the result of decision of the presence of an abnormal operation, if any, can be generated at a high response speed. Even when a re-closing instruction signal is applied in 0.3 seconds after the interrupting operation of the circuit breaker, although such high-speed reclosing is frequently demanded for the circuit breaker, the circuit breaker can be locked against making the closing operation if the interrupting operation is not normal.

The present invention is advantageous in that it can be simply applied to different kinds of switches having different ratings by merely changing the structural data of the movable parts or the characteristic stroke data as required. Further, according to the present invention, occurrence of an abnormal operation can be diagnosed on the basis of the characteristic stroke measured at the time of interrupting the current. Therefore, the diagnostic process of stopping the power supply and operating the circuit breaker under no load for inspecting the circuit breaker, becomes unnecessary. When the additional provision of the characteristic stroke measuring device is difficult in the case of application of the present invention to an existing circuit breaker, the period of time required for operation of an auxiliary contact (not shown) may be measured and compared with a calculated one, as disclosed in JP-A-No. 61-203820. It is needless to mention that variations of the actuating force, gas pressure and actuation reaction force due to pressure rise during current interrupting operation must also be taken into account in the calculation.

In the case of closing the switch such as the gas circuit breaker, a discharge current initially flows for about 0.5 cycles, and the closing operational characteristic of the circuit breaker is also affected by the magnitude and phase of the current, the environmental gas pressure and the actuating fluid pressure, as in the case of the interrupting operation. The present invention can be applied to the closing operation of the circuit breaker by replacing the interrupting instruction signal and the interrupting characteristic stroke by a closing instruction signal and a closing characteristic stroke respectively in the embodiments shown in FIGS. 2 and 3.

The present invention provides the following meritorious effects:

1. The characteristic stroke of the movable electrode of the switch is freed from the adverse effects of variations of the actuating force, environmental gas pressure and actuation reaction force due to pressure rise during current interrupting operation. Therefore, the sensitivity of detection of an abnormal operation can be improved.

2. The diagnostic process of stopping the power supply and operating the switch under no load for the purpose of inspection is unnecessary.

3. Because of the incorporation of the characteristic stroke calculation circuit in the operational characteristic measuring device, the actually measured values of the current and environmental gas pressure can be directly used to improve the accuracy or sensitivity of detection of an abnormal operation.

4. Because of the incorporation of the stroke reference circuit and the associated stroke memory in the operational characteristic measuring device, the period of time required for detection of an abnormal operation can be greatly shortened.

What is claimed is:

1. A switch operation monitoring apparatus comprising:

a switch stationary electrode;

a switch movable electrode engageable with said stationary electrode;

an actuator connected to said movable electrode to selectively urge said movable electrode toward a circuit closing position or a circuit interrupting position;

means for simultaneously measuring a plurality of factors including an interrupting current waveform, an environmental gas pressure and an actuating fluid pressure; and an operational characteristic measuring device connected to said actuator and said factor measuring means, said operational characteristic measuring device previously calculating a theoretical operational characteristic of said actuator on the basis of at least one of the results of measurement of said interrupting current waveform, said environmental gas pressure and said actuating fluid pressure to use said calculated theoretical operational characteristic as a reference characteristic and comparing an actually measured operational characteristic of said actuator with said reference characteristic to decide whether the operation of said actuator is normal or abnormal.

2. A switch operation monitoring apparatus according to claim 1, wherein said operational characteristic measuring device calculates in real time said theoretical operational characteristic used as said reference characteristic on the basis of said interrupting current waveform, said environmental gas pressure and said actuating fluid pressure actually measured by said factor measuring means.

3. A switch operation monitoring apparatus according to claim 1, wherein said operational characteristic measuring device calculates previously said theoretical operational characteristic used as said reference characteristic using said interrupting current waveform said environmental gas pressure and said actuating fluid pressure as parameters and stores said calculated theoretical operational characteristic in a memory.

4. A switch operation monitoring apparatus according to claim 1, wherein said operational characteristic measuring device calculates said theoretical operational characteristic used as said reference characteristic on the basis of the result of measurement of said interrupting current waveform.

5. A switch operation monitoring apparatus according to claim 1, wherein said operational characteristic measuring device calculates said theoretical operational characteristic used as said reference characteristic on the basis of the result of measurement of the period of time required for operation of an auxiliary contact making interlocking operation with said actuator.

6. A switch operation monitoring apparatus according to claim 1, wherein said operational characteristic measuring device measures the characteristic stroke of said movable electrode.

7. A switch operation monitoring apparatus comprising:

a switch stationary electrode;

a switch movable electrode engageable with said stationary electrode;

an actuator connected to said movable electrode to selectively urge said movable electrode toward a circuit closing position or a circuit interrupting position;

means for simultaneously measuring a plurality of factors including an interrupting current waveform, an environmental gas pressure and an actuating fluid pressure; and an operational characteristic measuring device connected to said actuator and said factor measuring means, said operational characteristic measuring device previously calculating a theoretical operational characteristic of said actuator on the basis of all of the results of measurement of said interrupting current waveform, said environmental gas pressure and said actuating fluid pressure to use said calculated theoretical operational characteristic as a reference characteristic and comparing an actually measured operational characteristic of said actuator with said reference characteristic to decide whether the operation of said actuator is normal or abnormal.

* * * * *